US011982512B2

(12) United States Patent
Gerlings

(10) Patent No.: US 11,982,512 B2
(45) Date of Patent: May 14, 2024

(54) FIREARM ACCESSORY MOUNTING SYSTEM

(71) Applicant: Phillip Gerlings, Gilbert, AZ (US)

(72) Inventor: Phillip Gerlings, Gilbert, AZ (US)

( * ) Notice: Subject to any disclaimer, the term of this patent is extended or adjusted under 35 U.S.C. 154(b) by 0 days.

(21) Appl. No.: 17/182,377

(22) Filed: Feb. 23, 2021

(65) Prior Publication Data

US 2021/0262768 A1 Aug. 26, 2021

Related U.S. Application Data

(60) Provisional application No. 62/980,896, filed on Feb. 24, 2020.

(51) Int. Cl.
*F41G 11/00* (2006.01)
*F41C 27/00* (2006.01)

(52) U.S. Cl.
CPC ..... *F41G 11/004* (2013.01); *F41C 27/00* (2013.01)

(58) Field of Classification Search
CPC ..... F41G 11/004; F41C 27/00
See application file for complete search history.

(56) References Cited

U.S. PATENT DOCUMENTS 3,066,375 A * 12/1962 Knowles ..... F41C 23/02 24/639
8,020,335 B2 * 9/2011 Larsson ..... F41C 27/00 42/127
8,925,236 B1 * 1/2015 Mayberry ..... F41G 1/387 42/124
9,599,439 B1 * 3/2017 Sylvester ..... F41G 11/003
9,696,112 B2 * 7/2017 Gottzmann ..... F41G 11/003
9,766,035 B2 * 9/2017 Storch ..... F41C 23/16
9,766,036 B2 * 9/2017 Daley, Jr. ..... F41G 11/004
9,964,380 B1 * 5/2018 Oglesby ..... F41C 23/16
10,551,145 B2 * 2/2020 Kincel ..... F41C 23/16
10,605,572 B1 * 3/2020 Bartoszewicz ..... F41G 11/003
2004/0009034 A1 * 1/2004 Miller ..... F41G 11/003 403/363
2009/0100734 A1 * 4/2009 Swan ..... F41G 11/003 42/71.01
2012/0167434 A1 * 7/2012 Masters ..... F41G 11/003 42/90
2015/0219422 A1 * 8/2015 Kincel ..... F41C 23/16 29/525.11
2015/0285583 A1 * 10/2015 Mayberry ..... F41A 23/08 42/71.01
2016/0209162 A1 * 7/2016 Geissele ..... F41C 23/02
2016/0349011 A1 * 12/2016 Jen ..... F41G 11/001
2017/0138693 A1 * 5/2017 Roberts ..... F41G 11/001
(Continued)

*Primary Examiner* — Michelle Clement
(74) *Attorney, Agent, or Firm* — Accelerate IP LLC

(57) ABSTRACT

A firearm accessory mounting system, wherein the firearm accessory mounting system can comprise a firearm accessory having at least one attachment point wherein the attachment point has at least one thread hole. A firearm handguard can have at least one mounting surface with at least one thru hole wherein the firearm accessory can be removably attached to the mounting surface by the attachment point and at least one fastener. The mounting surface can further comprise two parallel edges that can clock the right orientation of the firearm accessory with respect to the fore end of a firearm wherein the firearm accessory can always be orientated or pointed in the correct direction.

11 Claims, 6 Drawing Sheets

(56) References Cited

U.S. PATENT DOCUMENTS

| | | | | |
|---|---|---|---|---|
| 2017/0205202 | A1* | 7/2017 | Teetzel | F41C 27/00 |
| 2018/0216911 | A1* | 8/2018 | Jen | F41G 11/003 |
| 2019/0113306 | A1* | 4/2019 | Kincel | F41C 23/16 |
| 2019/0249958 | A1* | 8/2019 | Teetzel | F41G 3/12 |
| 2020/0011636 | A1* | 1/2020 | Jen | F41C 33/007 |
| 2020/0208946 | A1* | 7/2020 | Cahill | F41G 11/001 |
| 2021/0088310 | A1* | 3/2021 | Planck | F41G 11/003 |
| 2021/0325144 | A1* | 10/2021 | Kincel | F41C 23/16 |
| 2021/0372736 | A1* | 12/2021 | Zhou | F21V 21/0885 |
| 2021/0389080 | A1* | 12/2021 | McMillan | F41C 33/029 |
| 2022/0049934 | A1* | 2/2022 | Moseley | F41G 1/42 |

* cited by examiner

FIREARM ACCESSORY MOUNTING SYSTEM

CROSS REFERENCE TO RELATED APPLICATIONS

The present application claims the benefit under 35 U.S.C. 119 of U.S. Provisional Patent Application Ser. No. 62/980,896 filed Feb. 24, 2020. The U.S. Provisional Patent Application Ser. No. 62/980,896 is hereby incorporated by reference in its entirety.

TECHNICAL FIELD

The present invention relates to the field of firearms and more particularly relates to an improved firearm accessory mounting interface.

BACKGROUND OF THE INVENTION

Modern firearms can use a broad range of accessories by a wide range of operators. Some of these accessories include scopes, tac-lights, laser sights, bipods, foregrips, or ammo carriers. Nearly all modern firearms are designed such that they can be configured by the end-user with each type of accessory and the end-user can tailor their firearm to fit their exact needs for their particular application. Standardized mounting platforms have been developed, such as the Picatinny rail platform (MIL-STD-1913 or STANAG 2324). The Picatinny rail is a cross-section shaped roughly like a wide T with the top of the T corresponding to the top of the rail. The rail has a number of evenly spaced transverse slots in the top spanning the width of the T-shaped cross section. Another universal mounting platform is the Magpul modular lock system which uses a slot on a handguard wherein the accessories are mountable directly from the front face of the slot using a cam T-nut that tightens when twisted into the slot. Other examples of mounting systems are Keymod picatinny rail section, and the Weaver mounting system both of which use an adapter attached to a Picatinny Rail System.

When adding an accessory onto a firearm the user must select a mounting system, all of which currently use a designated adapter for that particular accessory. The adapter connects or attaches to the accessory and the accessory assembly attaches to the chosen firearm's mounting system. The adapter is a component that is specifically designed to couple the chosen accessory to the firearm using one of the standard mounting systems. Commonly, this adapter mounts to solid geometry incorporated into the body of the accessory.

Alternatively, the manufacturer of the accessory system could select one of the universal interface standards and directly incorporate it into the accessory. This is commonly done with the MIL-STD-1913 standard on injection molded light bodies but could be done with other universal interfacing standards and with other manufacturing methods. There is a need for a mounting system that eliminates the need for an adapter which allows the accessory to directly mount to the firearm.

BRIEF SUMMARY OF THE INVENTION

The present invention provides among other things a firearm accessory mounting system, wherein the firearm accessory mounting system can comprise a firearm accessory having at least one attachment point wherein the attachment point has at least one thread hole. A firearm handguard can have at least one mounting surface with at least one thru hole wherein the firearm accessory can be removably attached to the mounting surface by the attachment point and at least one fastener. The mounting surface can further comprise two parallel edges that can clock the right orientation of the firearm accessory with respect to the fore end of a firearm wherein the firearm accessory can always be orientated or pointed in the correct direction. The mounting surface's thru holes can be spaced at least 21.50 mm apart, and the attachments point's threaded holes can be at least 21.50 mm apart.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for, and will also recite the word "function" (i.e., will state "means for performing the function of . . . "), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

Figure 1:
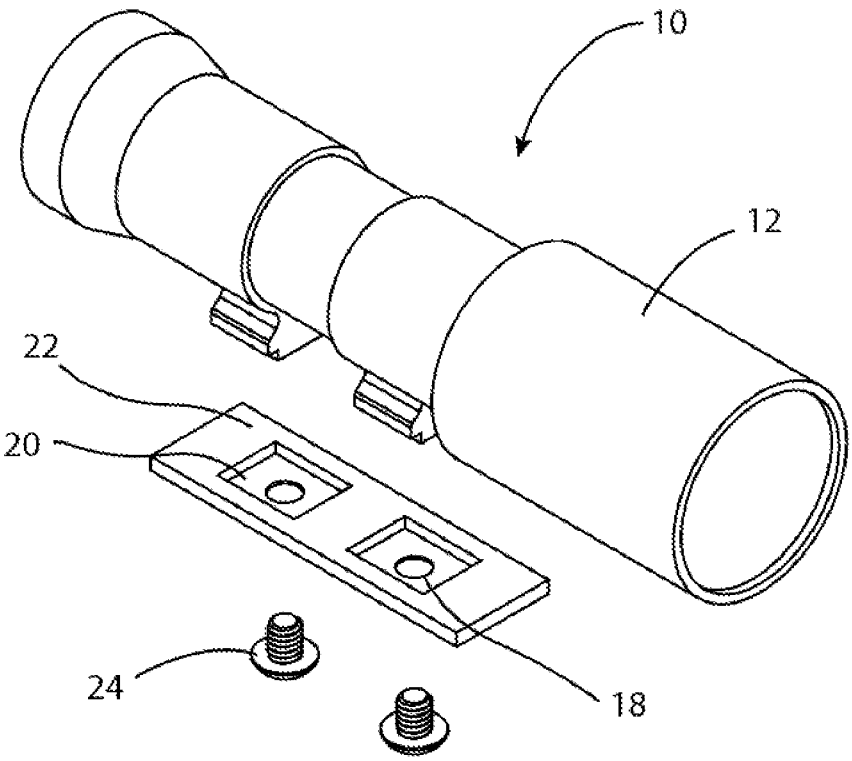
FIG. 1 is an isometric view of firearm accessory mounting system in accordance to one, or more embodiments.
Figure 2:
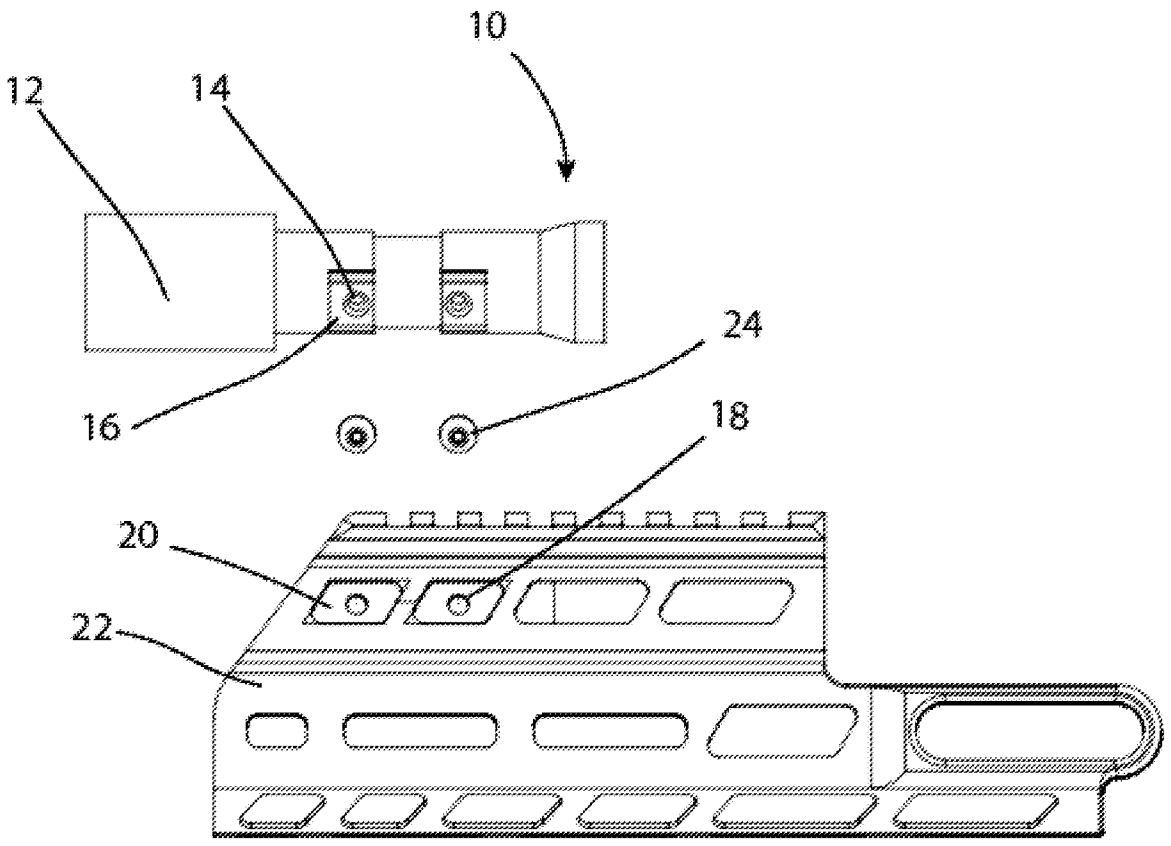
FIG. 2 is a side exploded view of firearm accessory mounting system in accordance to one, or more embodiments.
Figure 3:
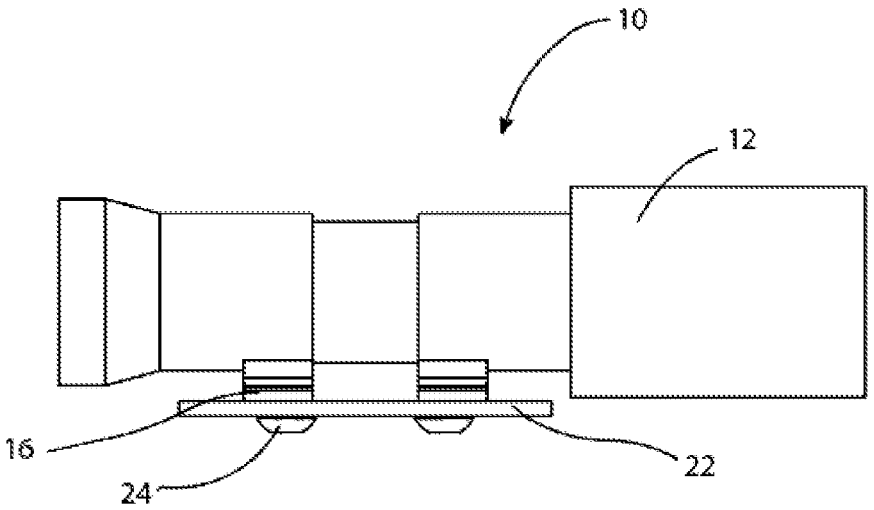
FIG. 3 is a side view of firearm accessory mounting system in accordance to one, or more embodiments.
Figure 4:
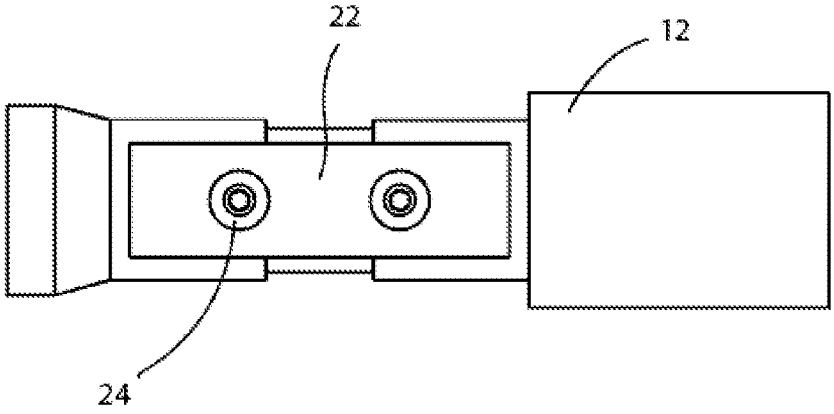
FIG. 4 is a bottom view of firearm accessory mounting system in accordance to one, or more embodiments.
Figure 5:
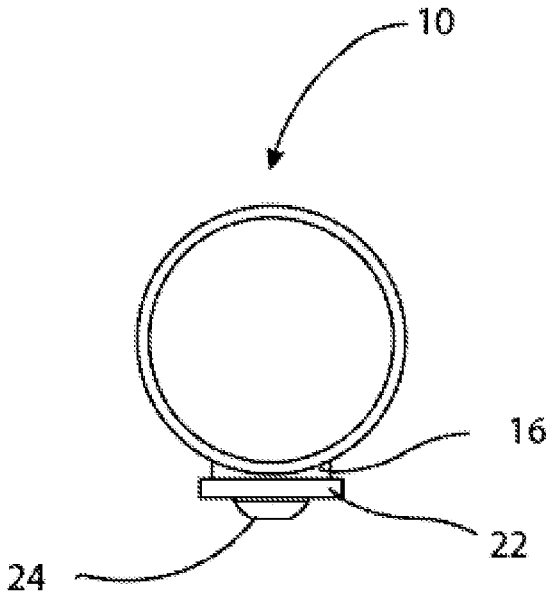
FIG. 5 is a front view of firearm accessory mounting system located on a firearm handguard in accordance to one, or more embodiments.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Referring initially to FIGS. 1-5, a firearm accessory mounting system is shown generally at 10. The firearm accessory mounting system 10 can comprise a firearm accessory 12 having at least one attachment point 16 wherein the attachment point can have at least one connector 14. The attachment points 16 can be any shape such as, a rectangle, a square, or a curved shape having any curvature, however in the preferred embodiment the attachment point is a substantially flat surface. The connector 14 can be any connector known to those having skill in the art. In a particular embodiment, the connector 14 is a threaded hole. The firearm accessory 12 can be, for example, a light, a bipod, a grip, a laser, a sling, a sight, or the like.

The firearm accessory mounting system 10 can further comprise a firearm handguard 22 wherein the firearm handguard can have at least one mounting surface 20 having at least one thru hole 18 wherein the firearm accessory 12 can be removably or permanently attached to the firearm handguard or mounted directly onto the firearm (not shown) by at least one fastener 24. The firearm handguard 22 can be attached to the front of the firearm (not shown) so that the user can grip the firearm. The firearm handguard 22 can be free floating or a drop-in wherein the firearm handguard can be attached to the firearm at one point or multiple points. The fasteners 24 can be for example, bolts, screws, rounded head screws, socket head cap screws, clips, or the like. In a particular embodiment, the fasteners 24 can match the threaded holes of the connector 14 wherein the fasteners can hold protrude through the holes 18 on the handguard 22 and connect the accessory 12 onto the handguard.

The mounting surface 20 can have two parallel edges that clock the orientation of the firearm accessory 12 with respect to the fore end of the firearm. The mount surface 20 parallel edges can be vertical, horizontal or can be at an angle which allows for the correct clocking of the firearm accessory 12 with respect to the fore end of the firearm. The mounting surface 20 can be recessed 23 into the handguard 22 or it can be extended outwardly from a surface that the attachment points 16 can be mated to. The recess 23 can be a substantially similar shape as the attachment points 16 wherein the attachment points can be inserted into the recess and bottom out on the mounting surface 20. The mounting surface 20 can be for example, a square, a rectangle, parallelogram, hexagon, or the like. The attachment points 16 can have an opposing surface from the mounting surface 20 wherein the attachment points can be recessed or extend outwardly opposite of the mounting surface. The attachment points 16 can be, for example, a flat or curved surface that can mate to the mounting surface 20.

The thru holes 18 can be spaced, for example, between 1.5 mm and 50 mm, more preferably between 10 mm and 35 mm, and still more preferably spaced approximately 21.50 mm apart. The threaded holes 14 can be spaced, for example, between 1.5 mm and 50 mm, more preferably between 10 mm and 35 mm, and still more preferably spaced approximately 21.50 mm apart. Within the prior art there are a few common accessory mount configurations for firearms such as, 1913, Mlok and KeyMod geometry. The 21.50 mm spacing allows users to use one set of holes for the different type of mount configurations. The 21.50 mm spacing will give the user the flexibility to mount a wide array of firearm accessories 12 with or without an intermediary adapter plate to the user firearm's handguards, stock adapters, gun stocks, hand stop, grip, sling mount, or the like to the same set of holes.

Figure 6:
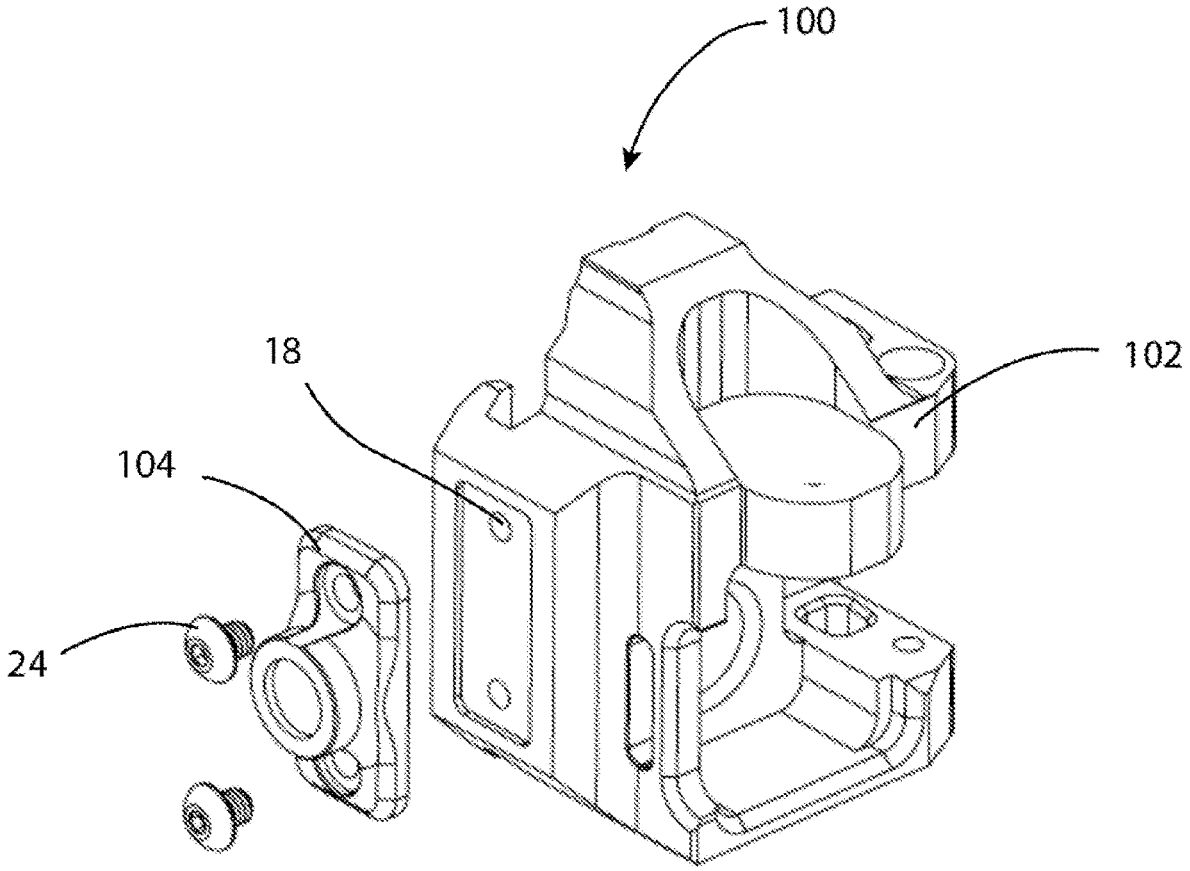
FIG. 6 is an isometric view of an example embodiment of firearm accessory mounting system located on a firearm handguard in accordance to one, or more embodiments.

FIG. 6 shows an example embodiment of a firearm accessory mounting system 100 attached to a stock adapter 102 with the 21.50 mm hole 18 spacing with at least one fastener 24 wherein the stock adapter can be attached to an adapter 104 or the accessory can be attached directly to the firearm.

Figure 7A:
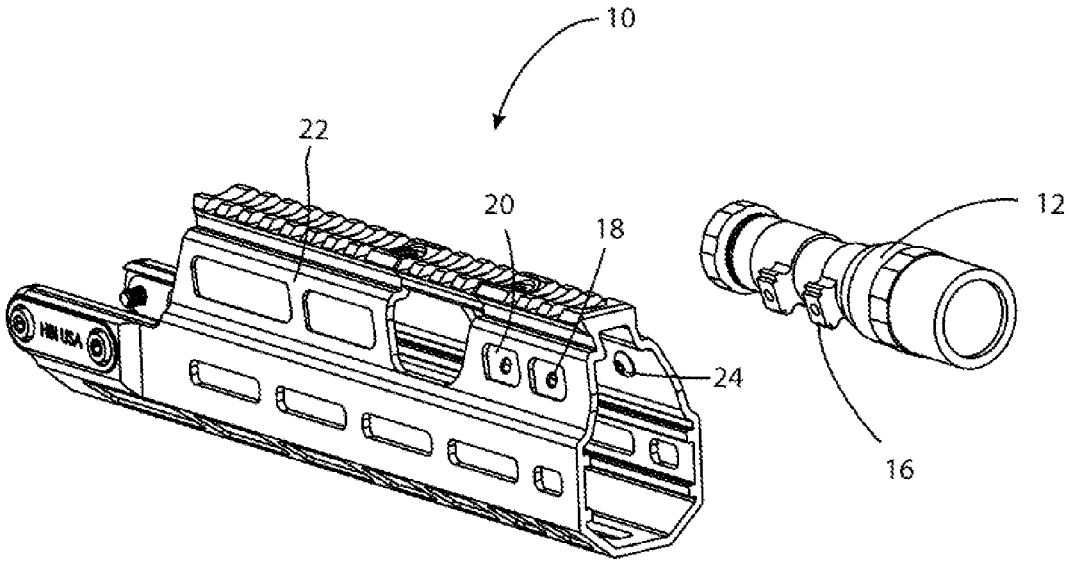
FIG. 7*a* is an isometric view of an example embodiment of firearm accessory mounting system located on a firearm handguard in accordance to one, or more embodiments.
Figure 7B:
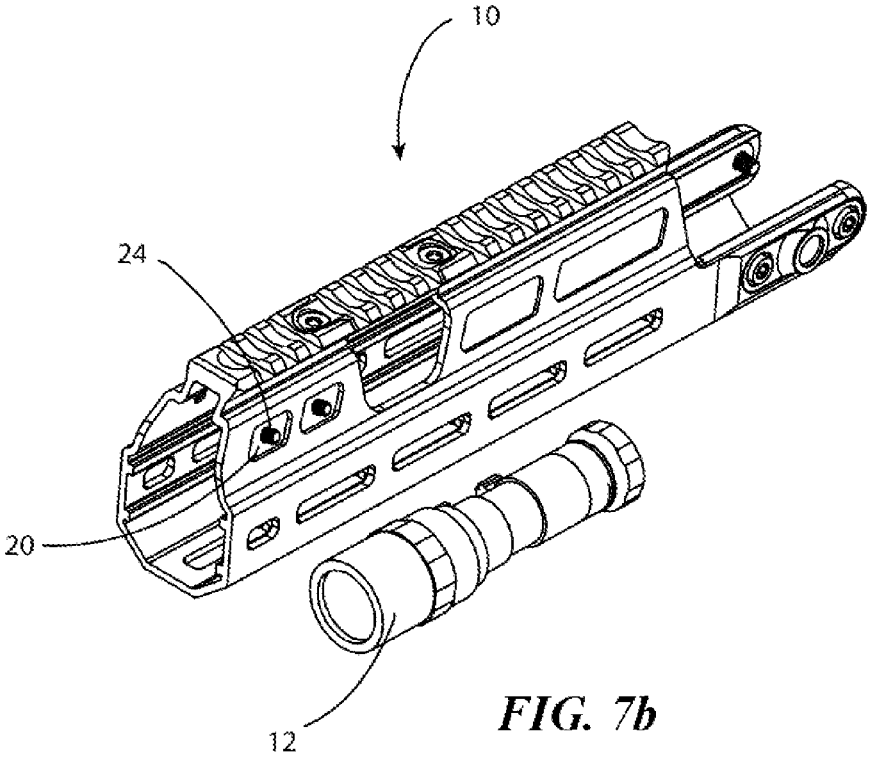
FIG. 7*b* is an isometric view of an example embodiment of firearm accessory mounting system located on a firearm handguard in accordance to one, or more embodiments.

FIGS. 7*a* and 7*b* shows another example embodiment wherein the handguard 22 has the holes 18 at the 21.5 mm spacing for the fasteners 24 wherein FIG. 7*a* shows the back of the fasteners 24 in the holes and the attachment points 16 on the accessory 12, and FIG. 7*b* shows the fasteners and the mounting surface 20.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

I claim:

1. An accessory mounting system for a firearm having an axis, and a handguard with an interior, an exterior, a first exterior surface, and at least one extension extending into or out from the first exterior surface, wherein the extension comprises a side periphery having at least two extension edges, and a mounting surface having at least one mounting surface thru hole, the system comprising:

a firearm accessory coupled to an attachment point having at least one threaded cavity configured to align with the at least one mounting surface thru hole, wherein the attachment point has at least two attachment point edges that generally correspond to the extension edges to clock the accessory relative to the axis when the attachment point is coupled to the mounting surface;

at least one threaded fastener that passes through the at least one mounting surface thru hole from the interior of the handguard and engages with the threaded cavity to removably attach the firearm accessory to the exterior of the handguard.

2. The accessory mounting system according to claim 1, wherein the attachment point is configured to fit within or encompass the extension to clock the orientation of the firearm accessory with respect to the axis.

3. The accessory mounting system according to claim 1, wherein the at least one mounting surface thru hole is two mounting surface thru holes and at least one threaded cavity is two threaded cavities that align with the mounting surface thru holes.

4. The accessory mounting system of claim 3 wherein the threaded cavities are spaced at least 21.50 mm apart.

5. The accessory mounting system according to claim 1, wherein the firearm accessory is a light body, a bipod, a grip, a sling, or a sight.

6. The accessory mounting system according to claim 5, wherein the light body is a flashlight or a laser sight.

7. The accessory mounting system according to claim 1, wherein the attachment point includes a substantially flat surface.

8. The accessory mounting system according to claim 1, wherein the extension edges are substantially horizontal to the axis.

9. The accessory mounting system according to claim 1, wherein the at least one extension extends into the first surface and is substantially parallel to the first surface, and wherein the attachment point fits into the extension.

10. The accessory mounting system according to claim 9, wherein the at least one threaded fastener is configured to bottom out on the mounting surface.

11. The accessory mounting system according to claim 1, wherein the mounting surface extends from the first surface and is substantially parallel to the first surface, and wherein the attachment point has a body that fits around the extended mounting surface and a recessed attachment point to allow the attachment point to contact the mounting surface, and wherein the clocking body is configured to bottom out in the extension.

* * * * *